United States Patent [19]

Larson et al.

[11] 4,406,410

[45] Sep. 27, 1983

[54] METHOD AND APPARATUS FOR ADDING AND MIXING SECOND COHESIVE POWDERS IN A FLUIDIZED BED BLENDER

[75] Inventors: Richard I. Larson; Henry C. Brassfield; John T. Adomitis, all of Wilmington, N.C.

[73] Assignee: General Electric Company, San Jose, Calif.

[21] Appl. No.: 346,874

[22] Filed: Feb. 8, 1982

Related U.S. Application Data

[63] Continuation of Ser. No. 120,229, Feb. 11, 1980, abandoned.

[51] Int. Cl.[3] ..... B02C 19/12

[52] U.S. Cl. ..... 241/5; 241/18; 241/101 B; 241/275; 366/101

[58] Field of Search ..... 241/101 B, 5, 275, 18; 423/261, DIG. 15; 366/101, 107, 183, 155, 174

[56] References Cited

U.S. PATENT DOCUMENTS

| | | | |
|---|---|---|---|
| 2,586,818 | 2/1952 | Harms | 366/183 X |
| 3,940,908 | 3/1976 | Dazen et al. | 53/59 R |
| 4,138,067 | 2/1979 | Planiol | 241/275 |
| 4,168,914 | 9/1979 | Larson et al. | 366/101 |
| 4,172,667 | 10/1979 | Zenz et al. | 366/107 |

*Primary Examiner*—Mark Rosenbaum

*Attorney, Agent, or Firm*—Ivor J. James, Jr.; Samuel E. Turner; Raymond G. Simkins

[57] ABSTRACT

A method and apparatus for the introduction of second cohesive powders into an improved fluidized bed blender containing $UO_2$ powder, and for blending such second cohesive powders with the $UO_2$ powder in the fluidized bed blender. The apparatus comprises an eductor, an improved pressurized vortec mill, a pneumatic conveying system that operates in turbulent flow, and an improved fluidized bed blender. The method and apparatus provide for injection and uniform dispersion of a second cohesive powdered ingredient or ingredients having hydrophobic, hydrophilic or hygroscopic properties in the fluid bed blender adjacent the bottom of the fluidized bed therein during the blending operation, thereby minimizing entrainment of the second powder mixture and providing a homogeneous blend of powders.

11 Claims, 6 Drawing Figures

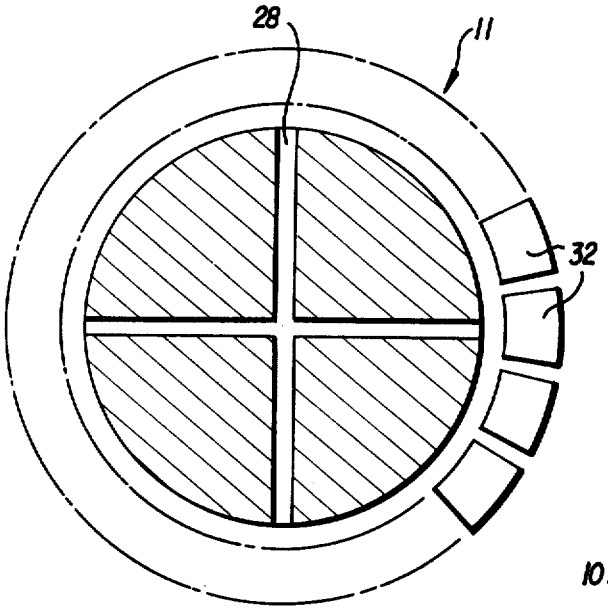
FIG. 6
FIG. 3
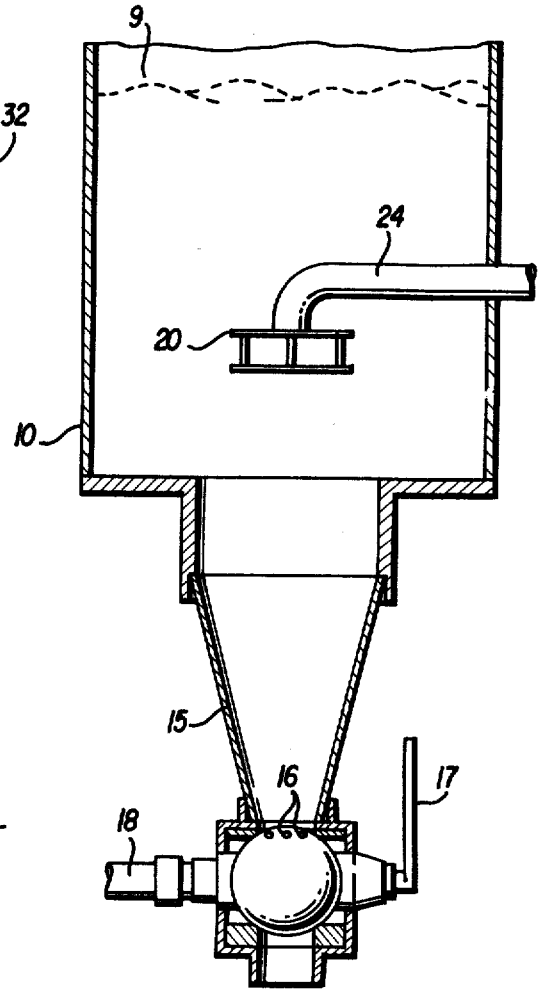
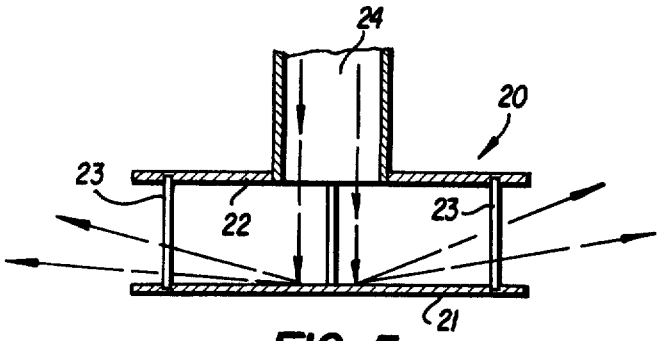
FIG. 5
FIG. 2
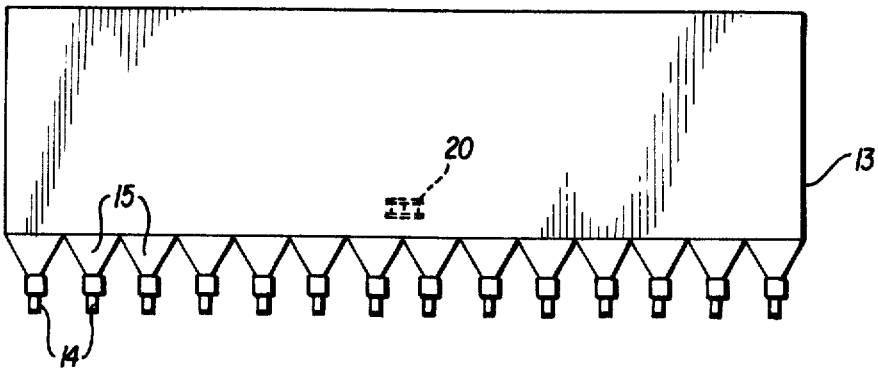

METHOD AND APPARATUS FOR ADDING AND MIXING SECOND COHESIVE POWDERS IN A FLUIDIZED BED BLENDER

This is a continuation, of application Ser. No. 120,229, filed Feb. 11, 1980, now abandoned.

BACKGROUND OF THE INVENTION

1. Field of the Invention

The invention is directed to improvements in the blending of $UO_2$ and second cohesive powders utilizing a fluidized bed blender and in particular to an improved method and apparatus for converting a hetergeneous mixture of solid $UO_2$ powders and second cohesive powders into a homogeneous blend.

2. Description of the Prior Art

The blending of particulate solids has been accomplished in the past in a variety of ways. Mechanical mixers of several types, such as tumble mixers, ribbon blenders and high shear mixers have been used. Spouting bed blenders and fluidized bed blenders have also been employed. In the prior art, $UO_2$ powders have primarily been blended with mechanical tumble-type blenders. This type of blender has not been satisfactory in producing blended batches meeting certain $UO_2$ powder homogeneity specifications. Failure to meet homogeneity specifications is thought to occur because of stagnant or dead zones within fluidized beds of ingredients being mixed in the blender and segregation problems during discharging. U.S. Pat. No. 4,168,914, issued to Larson et al. and assigned to the same assignee of the present invention, discloses an improved bubbling-bed fluidized bed blender. The Larson et al. blender eliminates the large dead zones encountered in prior art bubbling-bed fluidized bed blenders by providing an apparatus for containing the heterogeneous powders, preferably $UO_2$ powders, to be blended and comprises a vertically-oriented, slab-shaped mixing vessel having a fluidizing grid disposed at the bottom of the vessel. The fluidizing grid constructed according to the teaching of Larson et al. comprises a linear array of generally downwardly directed pyramidally-shaped hoppers each having walls converging into a conically-shaped opening. A plurality of gas orifices are provided for directing a flow of fluidizing gas upwardly into the bottom of each of the hoppers. Fluidizing gas is supplied to each of the orifices at a velocity sufficient to cause bubbles of fluidizing gas to rise through the mixture of powders and emerge from the powders for thus agitating the powders until a homogeneous blend of powders is achieved. The combination of the linear array of hoppers and the upwardly directed gas orifices eliminates the dead zones encountered with previous bubbling-bed fluidized bed blender designs.

However, of the known prior art apparatus for blending fine and cohesive powders in a fluidized bed blender, none have been effective in meeting product homogeneity specifications in the blending of $UO_2$ powders and secondary powder mixtures of widely different physical properties. More specifically, and due to their cohesive natures, some second powder mixtures including those which are hydrophobic, hydrophilic or hygroscopic, easily form large agglomerates which produce a poor dispersion. Additionally, certain low density agglomerates will undesirably classify or separate in a fluidized bed blender from the primary $UO_2$ powder due to stagnant or dead zones that exist at the bottom of the fluidizing bed. Furthermore, at certain gas flow rates utilized in introducing the second powder mixtures an inconsistency in the blending of the powders has been experienced.

SUMMARY OF THE INVENTION

An object of the present invention is to provide a new and improved method and apparatus for the blending of $UO_2$ powders and second cohesive powders and which is effective for providing a blend of powders closely approaching ideal homogeneity.

Another object of the present invention is to provide a new and improved system for blending cohesive powders that is effective in eliminating the formation of undesirable large agglomerates, compaction and build-up of powder blends and further provides for the homogeneous dispersion of cohesive second materials in the primary $UO_2$ powders to yield a highly homogeneous blend.

Still another object of the present invention is to provide a new and improved method and apparatus for homogeneously blending $UO_2$ powders and powdered second materials which are characterized by hydrophobic, hydrophilic and hygroscopic properties.

The objects of the invention are met in the utilization of an improved fluidized bed blender, an improved vortex mill and an eductor, all interconnected by a common pneumatic conveying system. The fluidized bed blender comprises a vertically-oriented mixing vessel having a fluidizing grid disposed at the bottom. The fluidizing grid comprises a linear array of pyramidally-shaped hoppers having contained within the base of each hopper a set of orifices designed for receiving and directing fluidizing jets of gas upwardly in a diverging swirl pattern along the walls of each hopper. Disposed above the linear array of pyramidally-shaped hoppers adjacent the base of the fluidizing bed in the mixing vessel is at least one impingement device including a deflection plate. A mixture of a second powdered ingredient and gas is introduced under pressure into the impingement device wherein the deflection plate uniformly disperses the second powdered ingredient into the swirling fluidizing bed of powdered $UO_2$ initially contained within the vertically-oriented mixing vessel. The term second material, second powdered material, or second powdered ingredient should be understood to mean that the second material, second powdered material, or second powdered ingredient can constitute either a mixture of hydrophobic, hydrophilic or hygroscopic materials as hereinafter defined and may include additional constituents such as a binder material and the like. Further, the second material, second powdered material or second powdered ingredient may be a single additive such as hydrophobic, hydrophilic or hygroscopic material which is to be homogeneously blended with the $UO_2$ powder.

The mixture of second powdered ingredient and gas is conveyed to the impingement device under a predetermined pressure from a vortec mill. In the mixture the second powdered ingredient is relatively large agglomerates (approximately 1200 microns) and the vortex mill receives the mixture of second powdered ingredient and gas under a predetermined pressure and comminutes the particles of the second powdered ingredient to an average particle size of from approximately 10 to approximately 60 microns, and with a preferred average size of about 15 microns.

The mixture of second powdered ingredient and gas is supplied to the vortex mill at a predetermined pressure from an eductor having a material feed inlet, a gas inlet for system pressurization, and an internal blending chamber. The blending chamber of the eductor initially and coarsely mixes the constituents of the second powdered mixture by means of turbulence created by the flow of an inert gas fed under a predetermined pressure into the blending chamber, and the coarse mixture is then pneumatically conveyed under pressure from the eductor to the vortex mill. In the vortec mill the particles are comminuted and further blended. From the mill the mixture is then fed at a predetermined pressure to the impingement device whereby it is introduced at a predetermined pressure into the fluidized bed blender and is uniformly dispersed for homogeneous blending with the powdered $UO_2$ contained therein.

DESCRIPTION OF THE DRAWING

The invention will be better understood from the following description taken in conjunction with the accompanying drawing, wherein:

FIG. 2 is an elevational view of the fluidized bed blender showing a number of hoppers and an impingement device constructed according to one embodiment of this invention.

FIG. 3 is a partial sectional view of the fluidized bed blender generally taken along line 3—3 of FIG. 1 and looking in the direction of the arrows.

FIG. 5 is an enlarged sectional view of the impingement device shown in FIG. 3.

FIG. 6 is a sectional view of the vortex mill taken along the lines 6—6 of FIG. 4 and looking in the direction of the arrows.

SUMMARY DESCRIPTION OF THE APPARATUS

Figure 1:
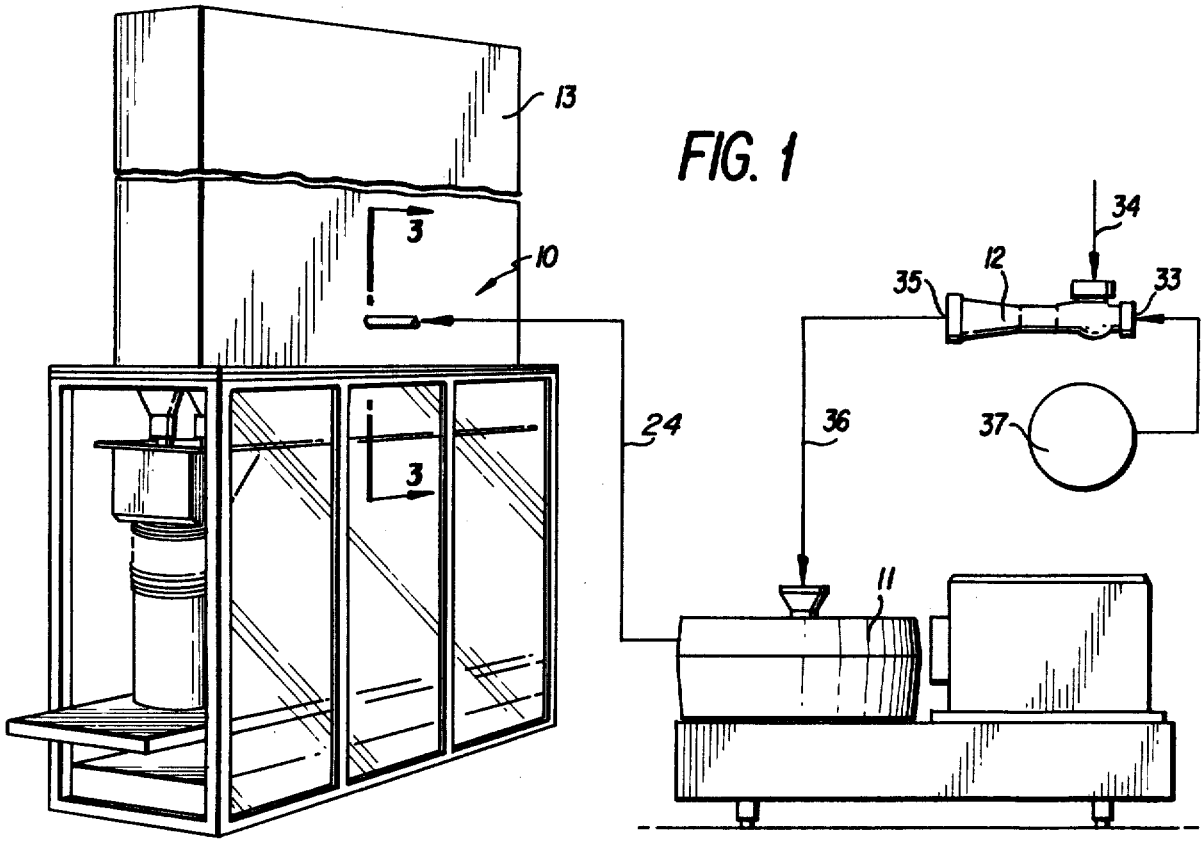
FIG. 1 is a perspective view of one embodiment of the apparatus of the present invention including a fluidized bed blender, a vortex mill and an eductor.

As shown in FIG. 1, there is an apparatus for blending powders. The apparatus basically comprises three major sections: an improved fluid bed blender 10, an improved vortex mill 11 and an eductor 12.

The blending of the powdered $UO_2$ and the second powdered ingredient, which as noted above can be a powdered hydrophobic, hydrophilic or hygroscopic material, occurs in the improved fluidized bed blender 10 as shown in FIG. 1. As shown in FIG. 2, the fluidized bed blender 10 comprises a vertically-oriented mixing vessel 13 having a fluidizing grid generally designated 14 disposed at the bottom thereof. The fluidizing grid 14 comprises a linear array of pyramidally-shaped hoppers 15 also shown in FIG. 2, each containing within the base thereof a set of orifices 16 as shown in FIG. 3 and provided for receiving and directing fluidizing jets of gas upwardly in a diverging swirl pattern along the walls of each hopper. The fluidizing jets of gas establish a boiling or bubbling-bed of the powdered $UO_2$ 9 with which the mixing vessel 13 is initially charged. Disposed above the linear array of pyramidally-shaped hoppers 15 is at least one impingement device 20 including a deflection plate 21 as shown in FIGS. 3 and 5.

Referring to FIGS. 3 and 5, the impingement device 20 is constructed in the form of a modified cage-like arrangement to cause a baffling effect and deflection of a mixture of gas and second material fed under pressure into the fluidized bed blender. More specifically, the device 20 comprises the previously mentioned deflection plate 21 and an upper plate 22. These plates are circular and are maintained in vertically spaced relation by four circumferentially spaced struts 23. The upper plate 22 is centrally apertured and is suitably attached to a conduit 24. With this arrangement the aforementioned mixture of powdered second ingredients and gas are introduced into the blender vessel and into the fluidized bed of $UO_2$ therein. The pressure causes the second powder to strike the deflection plate to provide a baffling effect on such powder as it enters the vessel and to disperse it uniformly about the circumference of the impingement device and into the fluidized bed of $UO_2$ 9 in the vessel. Additionally, the conduit structurally supports the impingement device at a predetermined position in the fluidizing bed adjacent the base of the bed. It is to be understood that while only one impingement device is illustrated and described, a plurality thereof arranged in a linear array above the hoppers 15 can be employed.

Figure 4:
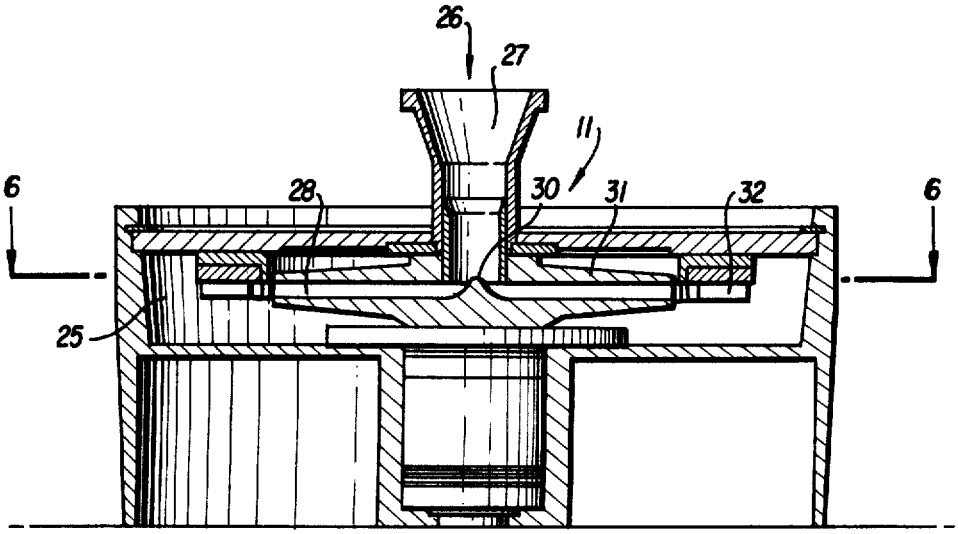
FIG. 4 is an enlarged sectional view of the vortec mill shown in FIG. 1.

Referring now to FIGS. 1 and 4, the conduit 24 is connected to an outlet 25 on the above-mentioned vortex mill 11 and thusly the mixture of gas and second powdered material is supplied to the conduit 24 from the mill. The vortex mill 11 receives the second material and gas mixture from the eductor 12 through a control inlet 26. In the vortex mill 11 the mixture particles are comminuted from a mixture of large agglomerates (approximately 1200 microns) to a mixture having an average particle size of from approximately 10 to approximately 60 microns, 15 microns preferred.

After the second powdered ingredient mixture has been comminuted to a preferred particle size, the second powdered ingredient mixture is conveyed under pressure from the vortec mill 11 by a conduit 36 into the impingement device 20 as shown in FIGS. 3 and 5.

The second powdered ingredient mixture is conducted pneumatically under pressure to the vortec mill from the eductor 12 as shown in FIG. 1.

The second powdered ingredient mixture is drawn into the eductor under vacuum through an opening 34 due to the effect of gas entering the eductor through an inlet port 33. The gas entering the eductor is an inert gas such as $N_2$ and may be provided by a gas source 37 as shown in FIG. 1. From the eductor 12, the second powdered ingredient mixture is conducted pneumatically into the vortec mill 11.

DETAILED DESCRIPTION OF THE COMPONENTS

Referring now to FIG. 3, one of the plurality of hoppers contained within the fluid bed blender is shown in relation to the impingement device 20 positioned within the blending chamber. The fluidized bed blender, utilized according to the present invention, is of a type generally known in the art and comprises a vertically-oriented, mixing vessel 13 having a fluidizing grid 14 disposed at the bottom of the vessel 10. The fluidizing grid 14 comprises a linear array of generally downwardly-directed pyramidally-shaped hoppers 15, each having walls converging into conically-shaped openings. A plurality of valves 17 are employed for discharging blended powders, such as $UO_2$ powders and a second powdered mixture, from the hoppers, one such valve 17 being disposed at the bottom of each hopper. A set of orifices 16 is incorporated at the base of each hopper, and the set of orifices is connected to a gas inlet 18 for a source of fluidizing gas by means of a manifold and connecting lines.

A general discussion of the design considerations involved in designing a prior art bubbling-bed fluidized bed blender including a consideration of particle properties, particle size, particle distribution, vessel geometry, superficial gas velocity, and circulation patterns is found in *Fluidization and Particle Fluid Systems*, by Frederick A. Zenz and Donald F. Othmer, Reinhold Chemical Engineering Series, Reinhold Publishing Corporation, New York, 1960.

The fluidizing bed blender of the present invention is distinguishable over prior art fluidized bed blenders by the incorporation of at least one impingement device 20 adjacent the fluidizing grid as shown in FIGS. 2 and 3. While only a single impingement device is shown, it should be recognized that a series of impingement devices can be utilized in the practice of this invention. The impingement device as shown in FIGS. 3 and 5 is of a cage-like construction having an inlet conduit 24, a circular deflection plate 21, an upper circular plate 22, and supporting members or struts 23 joining the upper and lower plates of the impingement device in vertically spaced relation. The particular construction of the impingement device adapts it for effecting baffling and deflection of the second powder mixture entering under pressure through the conduit 24 and results in a reduced rate and entry pressure of the second powdered mixture introduced into the mixing chamber of the fluidized bed. As the comminuted second powdered mixture feeds into the fluid bed blender from the vortex mill, the action of the impingement device allows for a broad distribution of the second powdered mixture within the $UO_2$ powder, and a homogeneous powder blend is achieved.

Referring now to FIGS. 1 and 4, the second powder mixture is fed into the vortex mill 11 through a vortex mill inlet 26 and passes into the interior through a feed funnel 27. The bearing system for the vortex mill is adapted for high pressure operation (>10 psig), to enable pressurized injection of the gas and second powdered material into the lower regions of the fluid bed blender. More specifically, the adaptation of the vortex mill bearing system to provide for operation at high pressure enables a high velocity flow within the pneumatic conveying system which alleviates agglomeration of entrapment of the second material after milling as the gas and second powdered material is conveyed to the fluid bed blender.

As the second powder mixture passes through the feed funnel 27 of the vortex mill 11, it contacts a spreader 30 at the base of a centrifugal rotor assembly. As the second powder mixture contacts the spreader surface, the particles are accelerated to approximately 213 m/sec through the centrifugal motion of the rotor operating at approximately 20,000 RPM. The particles are propelled radially outwardly through channels 28 formed by the lower spreader and upper rotor plate and collide forcefully against tungsten carbide impact blocks 32 located generally at the circumference of the lower spreader 30. Upon contact with the tungsten carbide impact blocks, the particles of the second powder mixture are comminuted, then conveyed under pressure out of the vortex mill through the pressurized conduit system 36 and into the fluid bed blender 10. It is to be understood that the comminution of the second powder particles can be effected by any suitable comminuting mill or means and the present invention is not limited to the use of a vortex mill.

The eductor 12, as shown in FIG. 1, is of conventional design, having a material feed inlet 34, a gas inlet 33, and an internal blending chamber which initially mixes the constituents of the second powder blend due to the turbulence caused by the flow of inert gas into the blending chamber from a gas source 37. As previously mentioned, the particle size of the second mixture is on the order of approximately 1200 microns. The eductor additionally provides pressurization of the conduit system 36 required for the operation of the overall blending apparatus. The eductor outlet 35 is connected directly by the conduit system 36, to the vortex mill inlet port 26 such that the initial blend of the second powdered mixture feeds into the vortex mill as shown schematically in FIG. 1. The details of the eductor referred to above do not form any part of this invention and the eductor may be of any suitable type for the initial introduction of the secondary materials into the blending apparatus, such as Type 264 used in the practice of this invention and manufactured by AMETK Inc., Cornwells Heights, PA. 19020.

OPERATION OF THE APPARATUS

The blending apparatus of the present invention is effective for homogeneously blending powders of widely different physical properties with $UO_2$ powder in a fluid bed blender. In operation, the vessel 13 of the bubbling-bed fluidized bed blender is filled with $UO_2$ powder through an inlet at the top thereof having a valve such as a butterfly valve (not shown), associated therewith for preventing the escape of powders during the blending process. The butterfly valve is not part of the present invention and any suitable type of valve may be employed. The vessel 13 is initially filled to about one-half of its height with a mixture of heterogeneous or unblended powder. Thus, the bottom half of vessel 13 serves as a mixing chamber for the vessel while the top half serves as a gas plenum where powders entrained within the fluidized gas may settle.

Blending of the particles in this type of blender is effected by bubbles of fluidizing gas emitted from the set of orifices 16 located at the base of and maintaining the vessel at an internal pressure of approximately 1 psig to approximately 5 psig. Bubbles of gas rise from the orifices throughout the bed to the top of the bed in wide sweeping zig-zag motions. Once a bubble is formed, adjacent particles flow around its upper portion and down to its lower cavity so that the bubble rises. Particles lying directly above the bubble are forced upwardly as others are pushed aside with some flowing down into the lower portion of the bubble filling its path. Thus, a rising bubble spreads particles radially in all directions. As a given bubble rises, particles filling its bottom cavity are packed slightly more tightly than particles immediately outside the bubble's path. The next bubble rising in that general region will follow a path through the less tightly packed particles just to the side of the first bubble's path. Thus, each successive bubble will tend to rise in a different location, blending other particles with the particles previously blended. As more and more bubbles rise through the particle bed, small adjacent bubbles join together forming larger ones. This action, along with the bubbles flowing toward low pressure regions, causes a wide sweeping zig-zag bubble motion, creating horizontal as well as vertical convection blending. Bubbles escaping from the top of the particle bed scatter some $UO_2$ powders into the gas plenum at the top of the mixing vessel 13. However, the compressed gas escapes from the particle bed in intermittent puffs. These intermittent puffs of gas allow particles that would normally be entrained in the gas flow an opportunity to fall back into the particle bed rather than being entrained and swept out with the fluidizing gas. It is to be emphasized that in the bubbling-bed fluidized bed blender herein described, although there is the aforementioned circulatory blending, there is actually no mass movement of the particle bed such as that existing in a spouting bed blender.

After the initial blending of the second powder mixture in the eductor, the mixture entrained in the inert gas is conveyed under pressure to the infeed port 26 of the vortex mill 11 and into the interior of the vortex mill through the feed funnel. As the second powder mixture flows through the vortex mill feed funnel it impacts on the surface of a spreader 30 having a pyramidal nipple-like convex center portion which gradually declines outwardly. The spreader surface acts in concert with an upper rotor plate through which passes the feed funnel. The rotor plate surface mirrors that of the spreader surface thereby forming radial channels 28 which gradually narrow to provide a circumferential exit adjacent the circular inpact blocks 32 at the circumference of the radial channels formed by the spreader surface and the rotor plate. The spreader rotates at approximately 20,000 rpm, and this force in concert with the input pressure of the conduit system acts to force the second particles mixture entrained in the inert gas through the radial channel and to impact against the tungsten carbide impact blocks at approximately 213 m/sec thereby causing the particle size of the second powder mixture to be reduced from approximately 1200 microns to particles having an average size of from approximately 5 to approximately 60 microns in diameter, approximately 15 microns preferred.

Having been reduced to a preferred micronic diameter in the improved vortex mill, the second powder mixture is now in a form to be blended with the $UO_2$ powder contained in the improved fluid bed blender 10.

The second powder mixture entrained in the inert gas exits the vortex mill by way of a discharge means 25 generally shown in FIG. 4 and is transported by the conduit system 36 to the impingement device input 24 as shown in FIG. 5. The second powdered ingredient mixture enters the fluidized bed blender by way of the impingement device located adjacent the base of the fluidized bed and preferably approximately two feet above the grid 14 or tops of the downwardly directed pyramidally-shaped hoppers 15.

The second powder mixture feeds into the impingement plate input 24 at from approximately 3 psig to approximately 5 psig and preferably about 3.5 psig, and contacts the deflection plate 21. The cage-like construction of the impingement device produces a baffling effect and in conjunction with the deflection plate causes a reduction in force whereby the second powder mixture enters the fluid bed blender at a rate of approximately 2 psig. The impingement plate effects an even distribution or dispersion of the second powder mixture within the fluidized bed of first powdered ingredient in the fluid bed blender.

The procedure involved in blending the second cohesive powders with the $UO_2$ powder is initiated with the activation of the eductor 12 thereby pressurizing the second powder mixture conduit system 36 and the vortex mill 11. Almost simultaneously the fluid bed blender 10 is activated to cause the $UO_2$ powder contained within the fluid bed blender to randomly circulate. The eductor is started initially to preclude any leakage of the $UO_2$ powder contained in the fluid bed blender into the pneumatic conduit system 36 by way of the impingement device 20.

After activating the eductor by injecting an inert gas, such as $N_2$ at the gas inlet at a pressure of approximately 25 psig, the pre-cooled second powdered material mixture is simultaneously introduced into the eductor at the material feed inlet 34, wherein it is drawn into the internal blending chamber and coarsely blended under the turbulence created by the inflow of gas and under a pressure therein of less than about 5 psig.

The second materials to be mixed are usually described as hydrophobic, hydrophilic, or hygroscopic. Because of their cohesive nature, they can easily form large agglomerates which produce a poor dispersion.

Hydrophobic materials such as zinc stearate, oils, fats, and waxes do not dissolve in water, but do adhere to each other. Consequently, to blend this type of material, the agglomerates must be reduced in size before adequate dispersion can be achieved.

Hydrophilic materials tend to absorb water and bond together. Such materials as carboyhydrates (starches, vegetable gums, and the like) and complex proteins fall in this category. These materials must also be reduced in size before adequate blending is obtained.

Inorganic materials including ammonium bicarbonate, ammonium oxalate, calcium chloride, and zinc chloride form a third category described as hygroscopic. These substances absorb moisture from the air. More specifically, deliquescent materials are hygroscopic powders of waste-soluble chemical salts that dissolve in water absorbed from the air. These materials are difficult to handle and must be fed in the dry state.

The second powdered material mixture having been coarsely blended in the eductor is pneumatically conveyed under pressure of approximately 1 psig to 3 psig and preferably about 2 psig to the vortex mill for comminution to a preferred particle size. The action of the vortex mill adds a pressure of about 2 psig, resulting in the somewhat higher pressure at which the mixture is conveyed to the blending vessel from the vortex mill. Subsequently, and as discussed above, this comminuted second powdered material mixture is pneumatically conveyed under pressure to the impingement device within the fluid bed blender which, in cooperation with the bubbling-bed of primary or first powdered material mixture, in this case $UO_2$ powder, effects a homogeneous blend of the first and second powdered material mixtures.

Once a homogeneous blend of the $UO_2$ powder and second powder mixture is achieved, the homogeneous blend is discharged from the hoppers by means of a plurality of valves, one such valve being disposed at the opening of each of the hoppers. These valves serve as outlets for the mixing vessel once a homogeneous blend of powders is achieved. When the blending process is finished the blended powder is rapidly and efficiently discharged according to a method described in U.S. Pat. No. 4,182,383—Adomitis et al., issued and assigned to the same assignee as the present invention. Other embodiments and applications of the invention may occur to those skilled in the art and it is intended by the appended claims to cover all such modifications.

What is claimed is:

1. A method for blending a mixture of $UO_2$ and a second powdered ingredient having hydrophobic, hydrophilic or hygroscopic properties comprising:

(a) introducing powdered $UO_2$ ingredient into a pressure-tight vessel;

(b) establishing a fluidized bed of said powdered $UO_2$ ingredient in said pressure-tight vessel; and (c) uniformly dispersing said second powdered ingredient in said fluidized bed by introducing said second powdered ingredient under pressure into said vessel by impingement of said second powdered ingredient against a deflection plate disposed within said fluidized bed, wherein said second powdered ingredient is a material selected from the group consisting of hydrophobic, hydrophilic and hygroscopic powders.

2. A method for blending a mixture of $UO_2$ and a second powdered ingredient according to claim 1, wherein said second powdered ingredient when introduced into said fluidized bed has an average particle size of from approximately 10 to approximately 60 microns.

3. A method for blending a mixture of $UO_2$ and a second powdered ingredient according to claim 1, wherein said second powdered ingredient when introduced into said fluidized bed has an average particle size of approximately 15 microns.

4. A method for blending a mixture of powdered ingredients comprising the steps of:

(a) introducing a first powdered ingredient into a pressure-tight vessel;

(b) establishing a fluidized bed of said first powdered ingredients in said vessel;

(c) introducing a gas into an eductor to initiate pressurization;

(d) thereafter adding a second powdered ingredient mixture to said eductor;

(e) mixing the gas and second powdered ingredient mixture under pressure in said eductor;

(f) conveying the gas and second powdered ingredient mixture under pressure to a comminuting mill and therein comminuting the second powdered ingredient mixture;

(g) conveying under pressure the gas and comminuted second powdered ingredient mixture from the comminuting mill to the pressure-tight vessel; and (h) introducing a second powdered ingredient under pressure into said vessel and impinging the comminuted second powdered ingredient mixture against a deflection plate disposed within said fluidized bed of the first powdered ingredient and uniformly dispersing said second powdered ingredient mixture into said first powdered ingredient mixture contained in said vessel for thereby homogeneously blending the first and second powdered mixtures.

5. A method for blending a mixture of powdered ingredients comprising the steps of:

(a) introducing a first powdered ingredient into a pressure-tight vessel;

(b) establishing a fluidized bed of said first powdered ingredients in said vessel;

(c) introducing a gas into an eductor to initiate pressurization of said eductor at a pressure of approximately 25 psig;

(d) introducing a second powdered ingredient mixture to said eductor;

(e) mixing the gas and second powdered ingredient mixture under pressure of less than about 5 psig in said eductor;

(f) conveying the gas and second powdered ingredient mixture from said eductor at a pressure of from approximately 1 psig to approximately 3 psig, to a vortex mill and therein comminuting the second powdered ingredient mixture;

(g) conveying the gas and comminuted second powdered ingredient mixture from the vortex mill to the pressure-tight vessel at a pressure of from approximately 3 psig to approximately 5 psig; and (h) introducing the comminuted second powdered ingredient mixture under pressure into said pressure-tight vessel and impinging same against a deflection plate disposed within said fluidized bed of the first powdered ingredient and thereby reducing to approximately 2 psig the pressure at which it is dispersed in said first powdered ingredient mixture contained in said vessel for homogeneously blending the first and second powdered mixtures.

6. A method for blending a mixture of powdered ingredients according to claim 5, further comprising:

(a) conveying the gas and second powdered ingredient mixture from said eductor at a pressure of approximately 2 psig, to said vortex mill and therein comminuting the second powdered ingredient mixture; and (b) conveying the gas and comminuted second powdered ingredient mixture from the vortex mill to the pressure-tight vessel at a pressure of approximately 3.5 psig.

7. A method for blending a mixture of powdered ingredients comprising the steps of:

(a) introducing a first powdered ingredient into a pressure-tight vessel;

(b) establishing a fluidized bed of said first powdered ingredients in said vessel;

(c) comminuting within a comminuting mill a second powdered ingredient mixture;

(d) transporting under pressure the comminuted second powdered ingredient mixture from the comminuting mill to said pressure-tight vessel; and (e) introducing the comminuted second powdered ingredient under pressure into said pressure-tight vessel impinging said comminuted second powdered ingredient mixture against a deflection plate disposed within said fluidized bed of the first powdered ingredient and uniformly dispersing said second powdered ingredient mixture into said first powdered ingredient mixture contained in said vessel for thereby homogeneously blending the first and second powdered mixtures.

8. A method for blending a mixture of powdered ingredients comprising the steps of:

(a) introducing a first powdered ingredient into a pressure-tight vessel;

(b) establishing a fluidized bed of said first powdered ingredients in said vessel;

(c) comminuting within a vortex mill a second powdered ingredient mixture;

(d) transporting the comminuted second powdered ingredient from the vortex mill to said pressure-tight vessel at a pressure of approximately 3.5 psig; and (e) introducing the comminuted second powdered ingredient under pressure into said vessel impinging said comminuted second powdered ingredient mixture against a deflection plate disposed within said fluidized bed of the first powdered ingredient and uniformly dispersing said second powdered ingredient mixture into said first powdered ingredient mixture contained in said vessel for homogeneously blending the first and second powdered mixtures.

9. A fluidized bed blending apparatus comprising:

(a) a vertically-oriented pressure-tight mixing vessel;

(b) means for introducing a first powdered ingredient into said mixing vessel;

(c) a fluidizing grid for establishing a fluidizing bed in said mixing vessel;

(d) at least one impingement device disposed above said fluidizing grid and including a deflection plate;

(e) means for introducing a second powdered ingredient into said impingement device under pressure and directing it against said deflection plate, whereby said second powdered ingredient is uniformly dispersed into the fluidizing bed of said first powdered ingredient in said mixing vessel; and (f) a pressurized comminuting means for receiving a mixture of gas and powdered ingredients under pressure and effective for comminuting and mixing said powdered ingredients, and means for conducting said mixture of gas and ingredients under pressure from said comminuting means to said impingement device.

10. An apparatus according to claim 9, further comprising;

(a) an eductor;

(b) means for introducing a gas under pressure into said eductor;

(c) means for introducing a powdered material into said eductor;

(d) an internal blending chamber for mixing said gas and powdered material; and (e) outlet means for delivering said gas and powdered material into said comminuting means.

11. A fluidized bed blending apparatus comprising:

(a) a vertically-oriented mixing vessel having a fluidizing grid disposed at the bottom thereof;

(b) a cage-like impingement device mounted within the vertically-oriented mixing vessel and including an inlet for delivering a gas fed powdered material mixture under pressure to said impingement device;

(c) conduit means for conveying a gas and powdered material mixture under pressure to said inlet of said impingement device;

(d) a vortex mill effective for high pressure operation having an outlet for conveying a gas and powdered material mixture under pressure from said vortex mill to said conduit means connecting the vortex mill to the inlet of said impingement device and including an inlet for receiving a gas powdered material mixture under pressure and means for mixing and comminuting the powdered material introduced therein;

(e) an eductor having a material feed inlet, a gas inlet, an internal blending chamber for initially blending a gas and powdered material mixture therein, and an outlet;

(f) conduit means connecting said vortex mill inlet with said eductor outlet for conveying said gas and powdered material mixture under pressure from said eductor to said vortex mill; and (g) means for predeterminedly pressurizing the apparatus comprising the mixing vessel and vortex mill.

* * * * *